United States Patent [19]

Tarver

[11] Patent Number: 5,046,861

[45] Date of Patent: Sep. 10, 1991

[54] VERTICALLY ORIENTED DRAWER SLIDE

[75] Inventor: Carl R. Tarver, Phoenix, Ariz.

[73] Assignee: Siemens Transmission Systems, Inc., Phoenix, Ariz.

[21] Appl. No.: 446,259

[22] Filed: Dec. 5, 1989

[51] Int. Cl.[5] ..... A47B 88/00

[52] U.S. Cl. ..... 384/20; 312/330 R; 384/23

[58] Field of Search ..... 384/20-23; 312/330 R-348

[56] References Cited

U.S. PATENT DOCUMENTS

| | | | |
|---|---|---|---|
| 3,123,416 | 3/1964 | Sövik, Jr. | 312/195 |
| 3,129,988 | 4/1964 | Kanzelberger | 312/345 |
| 3,160,448 | 12/1964 | Albernathy et al. | 308/3.6 |
| 3,259,444 | 7/1966 | Friend | 312/221 |
| 3,289,044 | 11/1966 | Ginsberg | 317/99 |
| 3,323,853 | 6/1967 | Stark | 312/331 |
| 3,328,107 | 6/1967 | Gutner | 312/347 |
| 3,330,613 | 7/1967 | Barth | 312/331 |
| 3,351,406 | 11/1967 | Ropiequet et al. | 312/332 |
| 3,363,960 | 1/1968 | Reiss et al. | 312/344 |
| 3,365,261 | 1/1968 | Gutner | 312/347 |
| 3,375,051 | 3/1968 | Anderson | 312/343 |
| 3,456,996 | 7/1969 | Heiniger-Schar | 312/347 |
| 3,650,577 | 3/1972 | Gutner | 308/3.6 |
| 3,694,049 | 9/1972 | Gutner | 312/347 |
| 3,702,717 | 11/1972 | Gutner | 308/3.6 |
| 3,751,126 | 8/1973 | Hudson | 384/23 |
| 3,804,484 | 4/1974 | West et al. | 312/347 |
| 3,851,943 | 12/1974 | Afful | 312/347 |
| 3,929,386 | 12/1975 | Read | 384/22 |
| 3,981,553 | 9/1976 | Gutner | 312/347 |
| 4,118,088 | 10/1978 | Dunning, III | 312/350 |
| 4,119,277 | 10/1978 | Barber et al. | 312/344 |
| 4,141,525 | 2/1979 | Miller | 248/251 |
| 4,162,114 | 7/1979 | Litchfield et al. | 312/330 |
| 4,176,890 | 12/1979 | Gorton | 312/343 |
| 4,191,434 | 3/1980 | Powell et al. | 312/214 |
| 4,193,649 | 3/1980 | Sharon | 312/346 |
| 4,239,309 | 12/1980 | De Fouw et al. | 312/221 |
| 4,304,449 | 12/1981 | Litchfield et al. | 312/341 |
| 4,389,079 | 6/1983 | Cosme | 312/330 |
| 4,449,766 | 5/1984 | Shook | 312/348 |
| 4,549,774 | 10/1985 | Bessinger et al. | 308/3.8 |
| 4,810,045 | 3/1989 | Lautenschläger | 312/341 |

*Primary Examiner*—Thomas R. Hannon

*Attorney, Agent, or Firm*—Jeffrey P. Morris

[57] ABSTRACT

A drawer slide device for suspending and supporting a drawer which permits the drawer to be opened and closed and limits the travel of the drawer includes a guide bar ridgedly attached to a drawer holder and having a slot therein, and a slide bar suspended from the guide bar slot by screws such that the screw heads can not pass through but may slide within the slot while holding the slide bar. The slide bar has a slot from which a drawer is suspended by screws that are similarly free to slide within the slide bar slot while holding the drawer. Friction reducing washers are interposed between bearing surfaces to permit ease of operation. The travel of the drawer is limited to a portion of the total of the slot lengths.

21 Claims, 6 Drawing Sheets

VERTICALLY ORIENTED DRAWER SLIDE

BACKGROUND OF THE INVENTION

1. Field of the Invention

The present invention relates to a drawer slide, and more particularly, to a slide which suspends a drawer from a framework and/or within an enclosure, permits the drawer to be opened and closed, and limits the travel of the drawer.

2. Description of the Prior Art

Drawer slides are well known and have been practiced for centuries, numerous alternative designs having been implemented. The present state of the art includes a variety of drawer slide pairs comprised of cooperating tracks, one of which is usually attached to the sidewalls of a cabinet, the other being attached to the drawer. U.S. Pat. No. 4,162,114 to Litchfield et al. is representative of such systems. Single track drawer slide systems having a track affixed to a cabinet below the drawer load for cooperating with a drawer mounted track rider have been developed. U.S. Pat. No. 4,389,079 to Cosme and U.S. Pat. Nos. 3,981,553, 3,702,717, 3,694,049 and 3,650,577 to Gutner disclose this type of bottom situated single track drawer slide. Numerous wheeled drawer slide systems have been designed to aid in reducing sliding friction between a stationary track portion affixed to a cabinet and a moveable track rider portion affixed to a drawer. U.S. Pat. No. 3,851,943 to Afful and the patent to Anderson, U.S. Pat. No. 3,375,051 teach such systems. The use of friction reducing pads composed of a material having a lower coefficient of friction than the unimproved slide assembly components and interposed between bearing surfaces is also common, and an example of such use is illustrated in the patent to Kanzelberger, U.S. Pat. No. 3,129,988.

The prior art does not include, however, a drawer slide for suspending a drawer from a single slide positioned above the drawer, nor a pair of such slides each being interchangeable, for suspending a drawer from a top portion of the drawer and for supporting the drawer's weight from below. Known drawer slides frequently permit a carried drawer load to skew and bind within its cabinet and/or the slide and also permit the drawer to be pulled from the cabinet inadvertently. Most common drawer slides have components which, when worn, permit the drawer to wrench free of its slide and become stuck within its cabinet or fall free of the cabinet. The higher quality, better operating slide systems currently available most often employ numerous and expensive parts such as wheels and ball bearings for carrying the drawer load reliably and with less effort. Known drawer slide designs are not amenable to carrying heavier loads and require extra-sturdy drawers to prevent torsional stress from deforming the drawer and pulling a drawer mounted component from a cooperating track. Common drawer slides are usually deficient in that they are not easy to disassemble and an unwieldy compromise is generally reached with regard to the ease with which a drawer may be removed from it's cabinet and how well it is retained when inadvertently pulled beyond its intended limit of travel.

An example of a drawer load not adequately carried by known drawer slides is the typical electrical equipment drawer. Frequently, the electrical circuitry of complex electrical devices is housed within pull-out electrical equipment drawers. Such drawers house plug-in circuit cards and other electrical components, their pull-out feature providing access to the components for installation and repair. Often, the numerous electronic components affixed to a pull-out component drawer have substantial weight and a sturdy drawer slide system to support them is required. Thus this application requires a drawer slide and support system which does not obstruct access to the front and back planes of the component drawer, but is capable of withstanding high loading forces in a vertical direction.

It is therefore an object of the present invention to provide a drawer slide composed of a pair of slides vertically arranged above and below a drawer load to which they are attached.

It is another object to provide a drawer slide having the capacity to operate above or below a load to suspend it or support it.

It is a further object to provide a drawer slide having a greater load capacity in the vertical direction than afforded by present designs.

It is an additional object to provide a high load capacity drawer slide which minimally restricts access to the side surfaces of a drawer.

It is yet another object to provide a drawer slide which is simple in construction and inexpensive to manufacture yet exhibits a long and dependable useful life.

It is still yet a further object to provide a drawer slide which ensures retention of the drawer securely within the holding means in which the drawer is installed but is also easy to disassemble.

SUMMARY OF THE INVENTION

The problems and disadvantages associated with the conventional devices utilized to suspend, support and permit the operation of drawers, are overcome by the present invention, which includes a pair of drawer slide assemblies, each having a guide bar with an elongated slot therein for slideably receiving two suspender screws. The suspender screws capture shouldered washers, pass through the slot, and insert into threaded standoff plugs which protrude from the surface of a slide bar. The slide bar has an elongated slot situated distal to the standoff plugs which is similar in form and function to the guide bar slot. An additional set of suspender screws with captured shouldered washers pass through the slot in the slide bar and insert into threaded holes in a drawer load. The guide bar of the first assembly of the pair is ridgedly affixed to an upper support within the drawer opening of the cabinet or frame in which the drawer is installed. The slidebar is suspended from the guide bar upon the suspender screws, the head portion of which rides in the elongated slot of the guide bar. A drawer is suspended from the suspender screws passing through and riding in the elongated slot of the slide bar. The second in the pair of assemblies has the same configuration as the first, is affixed to a bottom portion of the drawer by suspender screws protruding through the slide bar slot and its guide bar is ridgedly affixed to a bottom support within the drawer opening of the cabinet in vertical alignment with the first of the pair.

BRIEF DESCRIPTION OF THE FIGURES

For a better understanding of the present invention, reference is made to the following detailed description of an exemplary embodiment considered in conjunction with the accompanying drawings, in which.

DETAILED DESCRIPTION OF THE FIGURES

Figure 1:
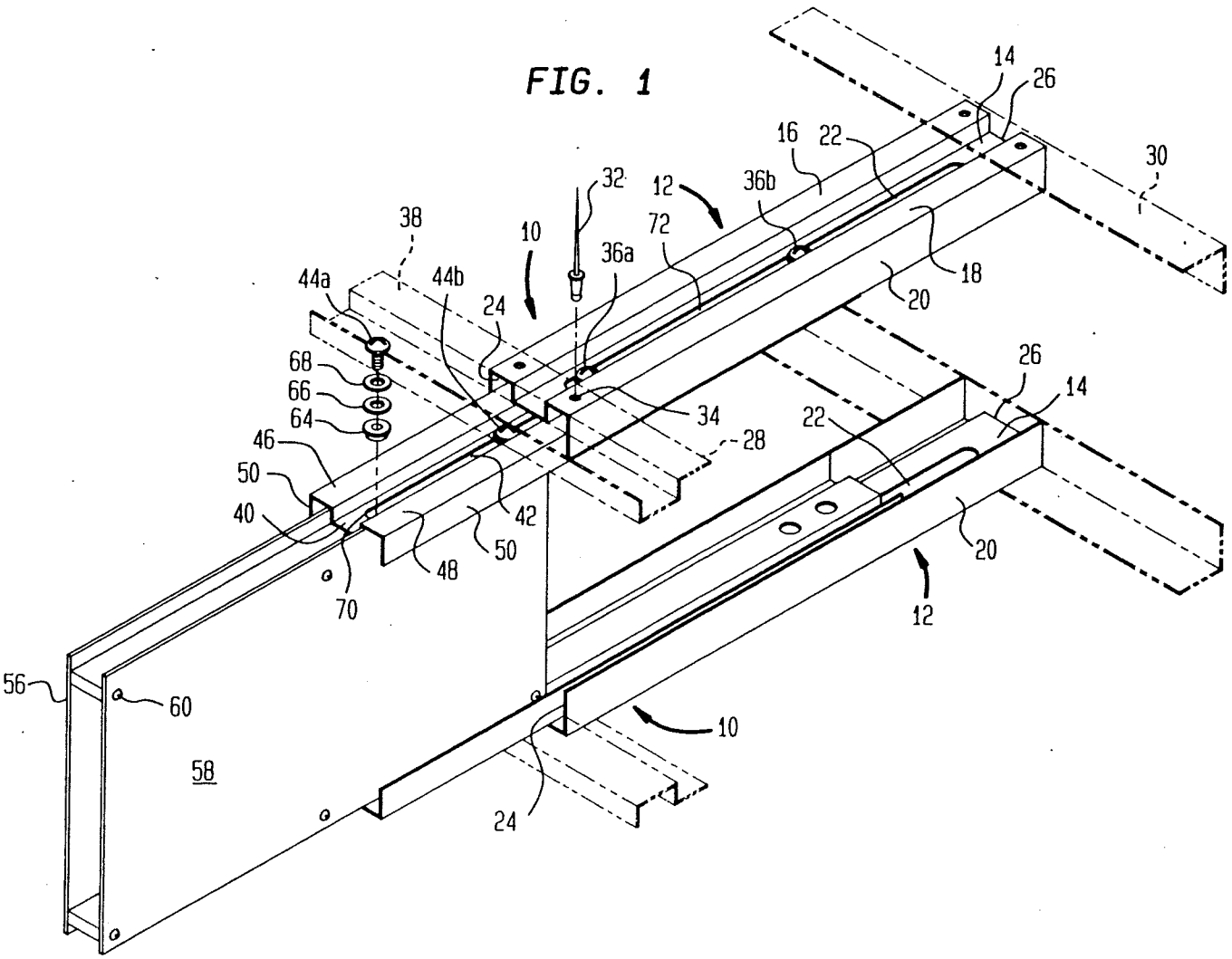
FIG. 1 is a perspective view of a drawer slide device constructed in accordance with one exemplary embodiment of the present invention.

Referring to FIG. 1 there is shown a drawer slide 10 having a guide bar 12 with a planar center panel 14 recessed below and disposed between left and right open box sections 16 and 18 which provide stiffness to the guide bar 12. The open box sections 16 and 18 have side plates 20 which extend substantially below the plane of the center panel 14. The center panel 14 of the guide bar 12 is provided with an elongated guide slot 22 which extends almost the entire distance from the front end 24 of the guide bar 12 to the back end 26. The front end 24 of the guide bar 12 is affixed to a front shelf stringer 28 of a cabinet or framework (not shown) and the back end 26 is affixed to a rear shelf stringer 30 via rivets 32 and cooperating rivet holes 34 drilled into the box sections 16 and 18 of the guide bar 12. Of course, other means of attachment could be used for attaching the guide bar 12 to the stringers 28 and 30. Other structural arrangements in lieu of the particular shelf stringers 28 and 30 shown are to be expected in the various applications of the device, but the means to attach the device to such alternative designs should be within the realm of the ordinary artisan.

Continuing to refer to FIG. 1, front slide bar suspender screw 36*a* and rear slide bar suspender screw 36*b* are illustrated positioned within the guide slot 22 for affixing to slide bar 38 by means described and illustrated below in reference to later figures. The slide bar 38 is constructed similarly to the guide bar 12, in that it has a flat center portion 40 with an elongated slide slot 42 for receiving front and rear drawer suspender screws 44*a* and 44*b*, and left and right box structures 46 and 48 with side members 50 extending downwardly therefrom. The slide bar 38 differs from the guide bar 12, however, in certain respects, and such differences will be discussed below in reference to figures which illustrate them. The guide bar 12 and slide bar 38 of the embodiment shown are preferably constructed of sheet metal which is bent into the configuration shown.

The front and rear drawer suspender screws 44*a* and 44*b* project through the slide slot 42 and affix to and suspend a drawer 54, which, in the embodiment shown is a composite having a left back plane 56 and a right back plane 58 each affixed by plane screws 60 to a sidewall 62 sandwiched therebetween. The back planes 56 and 58 extend above the sidewall 62 forming a U-shaped top surface which mates with the underside of the slide bar 38. The configuration of the drawer 54 shown is typical of an electrical equipment drawer for housing the multiple electrical components of a complex electrical device. The drawer suspender screws 44*a* and 44*b* each capture a set of washers between their heads and the upper surface of the flat center portion 40 proximate the slide slot 42. The washer set includes a plastic shoulder washer 64, a flat washer 66, and a toothed lock washer 68.

The drawer suspender screws 44*a* and 44*b* situated within the slide slot 42, retain the drawer 54 in slideable association with the slide bar 38. Similarly, the slide bar 38 is held in slideable association with the guide bar 12 by the slide bar suspender screws 36*a* and 36*b*. Starting with the almost completely open position as show in FIG. 1, the drawer 54 can be further withdrawn slightly. Eventually, the front drawer suspender screw 44*a* encounters the front terminal edge 70 of the slide slot 42 which causes the slide bar 38 and drawer 54 to move in unison. The slide bar 38 and drawer 54 may be further withdrawn until the front slide bar suspender screw 36*a* encounters the terminal front rim 72 of the guide slot 22 whereupon the drawer can be withdrawn no further. In closing the drawer 54, that is, in pushing it back into its rear most position, the drawer 54 and slide bar 38 interact as on opening until the rear drawer suspender screw 44*b* encounters the back terminal edge 74 (see FIG. 2) of the slide slot 42 and the rear slide suspender screw encounters the terminal back rim 76 of the guide slot 22, at which point the the drawer is closed and/or at it rear-most position. Both the slide bar 38 and the guide bar 12 may be coated with a friction reducing substance (not shown) such as Teflon or nylon to reduce frictional binding between the aforementioned components. The suggested method of applying the coating is to conformally coat the parts by the fluid bed process depositing a layer having an average maximum thickness of about 0.005 inch.

Figure 2:
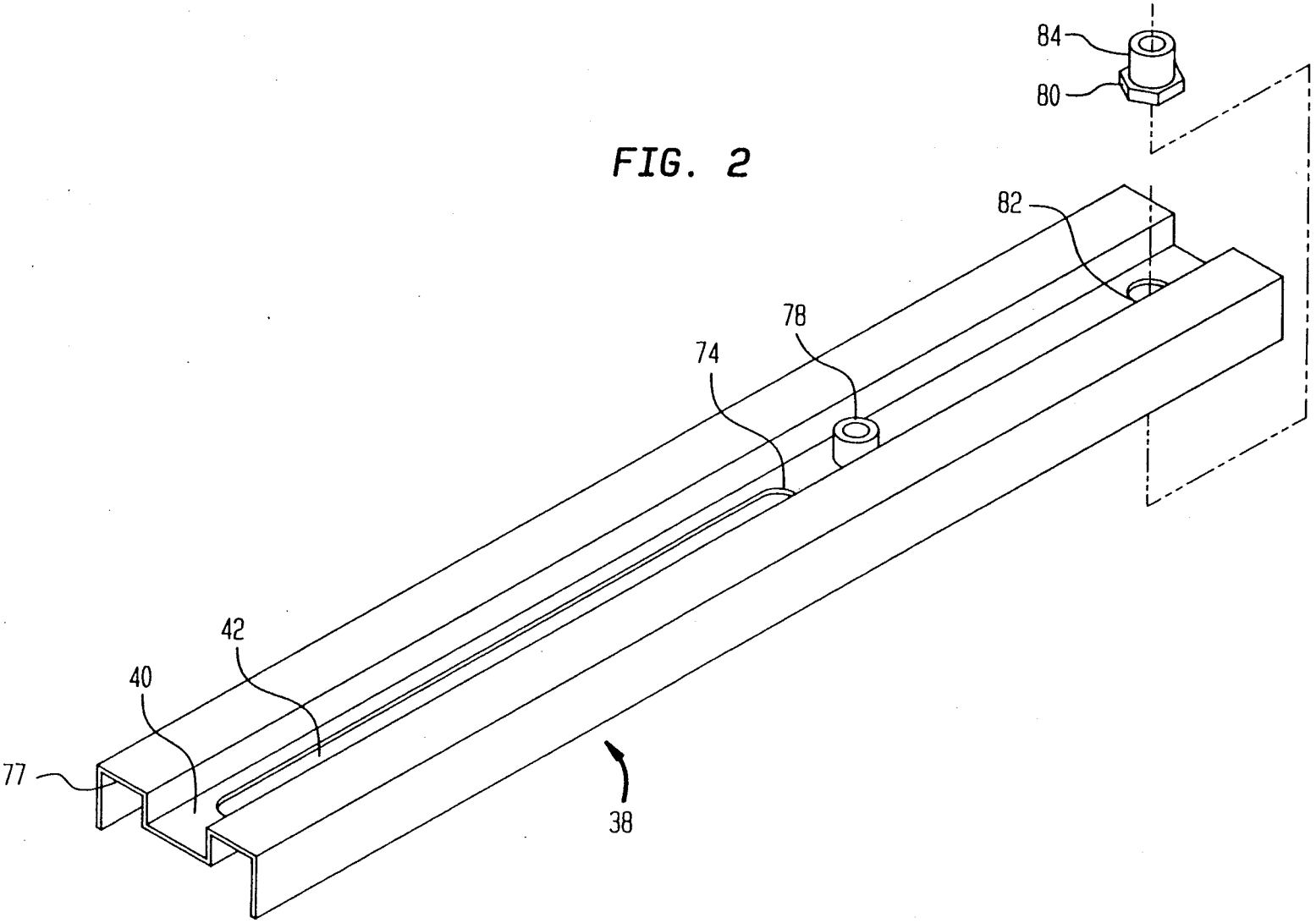
FIG. 2 is a perspective view of the slide bar portion of the device shown in FIG. 1.

Referring now to FIG. 2 wherein a detailed view of the slide bar 38 is depicted. Unlike the guide slot 22 in the guide bar 12 which extends almost the entire length of the guide bar 12, the slide slot 42 in the slide bar 38 extends from a point proximate the front edge 77 thereof to a point proximate a front threaded standoff plug 78 which has been forcibly inserted into a suitable stepped bore 82 through the flat center portion 40 of the slide bar 38. A rear threaded standoff plug 84 having the same configuration as the front threaded standoff plug 78 is depicted in FIG. 2 before its insertion into the bore 82 and a bottom lip 80 is illustrated.

Figure 3:
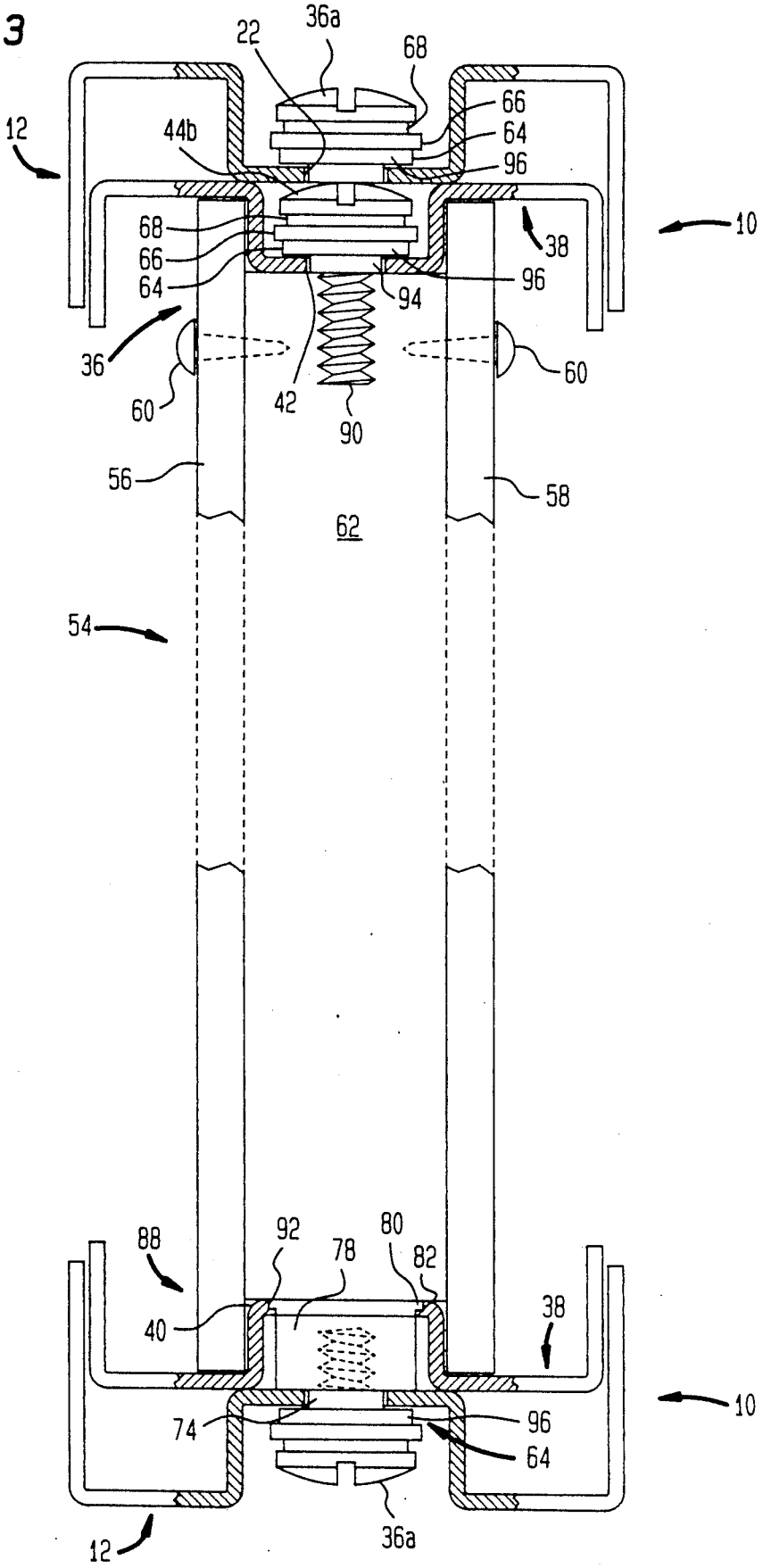
FIG. 3 is an end-on, front elevational, partially cross-sectional view of the device of FIG. 1.

Referring now to FIG. 3 a cross-sectional view of the device 10 applied to the top 86 and bottom 88 portions of a drawer 54 is depicted. An intermediate section of the drawer has been deleted and is replaced with dotted lines because it has no features in need of illustration. The top portion 86 of the drawer 54 includes inwardly directed plane screws 60 extending through the left and right back planes 56 and 58 and into the sidewall 62 thus holding the back planes 56 and 58 in association with the sidewall 62 and forming a U-shaped upper surface for receiving the slide bar 38. The rear drawer suspender screw 44*b* is depicted passing through the tooth washer 68, flat washer 66 , plastic shoulder washer 64, and slide slot 42 and affixing to a suitably threaded aperture 90 in the sidewall 62. The front slide bar suspender screw 36*a*, having a compliment of washers like the drawer suspender screws 44*a* and 44*b*, passes through the guide slot 22 and is illustrated behind and above the drawer suspender screw 44*b*. The illustration of the device 10 fitted to the bottom portion 88 of the drawer 54 has the drawer suspender screws 44*a* and 44*b* removed therefrom in order to obtain a clear view of the front threaded standoff plug 78 into which the slide suspender screw 36*a* has been threaded. The threaded standoff plugs 78 and 84 are forcibly pressed into stepped bores 82 in the center portion 40 of the slide bar 38. The bores 82 having an outer bore 92 for receiving the bottom lip 80 of the threaded standoff plugs 78 and 84 to prevent them from being pulled through the bores 82 by the, slide suspender screws 36*a* and 36*b*. The threaded standoff plugs 78 and 84 should have the maximum resistance to removal from the bores 82 possible and a pull-through force of about 450 lbs. to install and or remove the plug is preferred.

The drawer suspender screws 44*a* and 44*b* draw the sidewall 62 of the drawer 54 into contact with the narrow spindle portion 94 of corresponding the plastic shoulder washers 64 and and a washer portion 96 of said plastic shoulder washers 64 captures the slide bar 38 proximate the slide slot 42. Similarly, the slide bar suspender screws 36*a* and 36*b* draw the spindle portion 94 of associated plastic shoulder washers 64 into contact with the threaded standoff plugs 78 and 84 with the washer portion 96 capturing the guide bar 12 proximate the guide slot 22.

Figure 4:
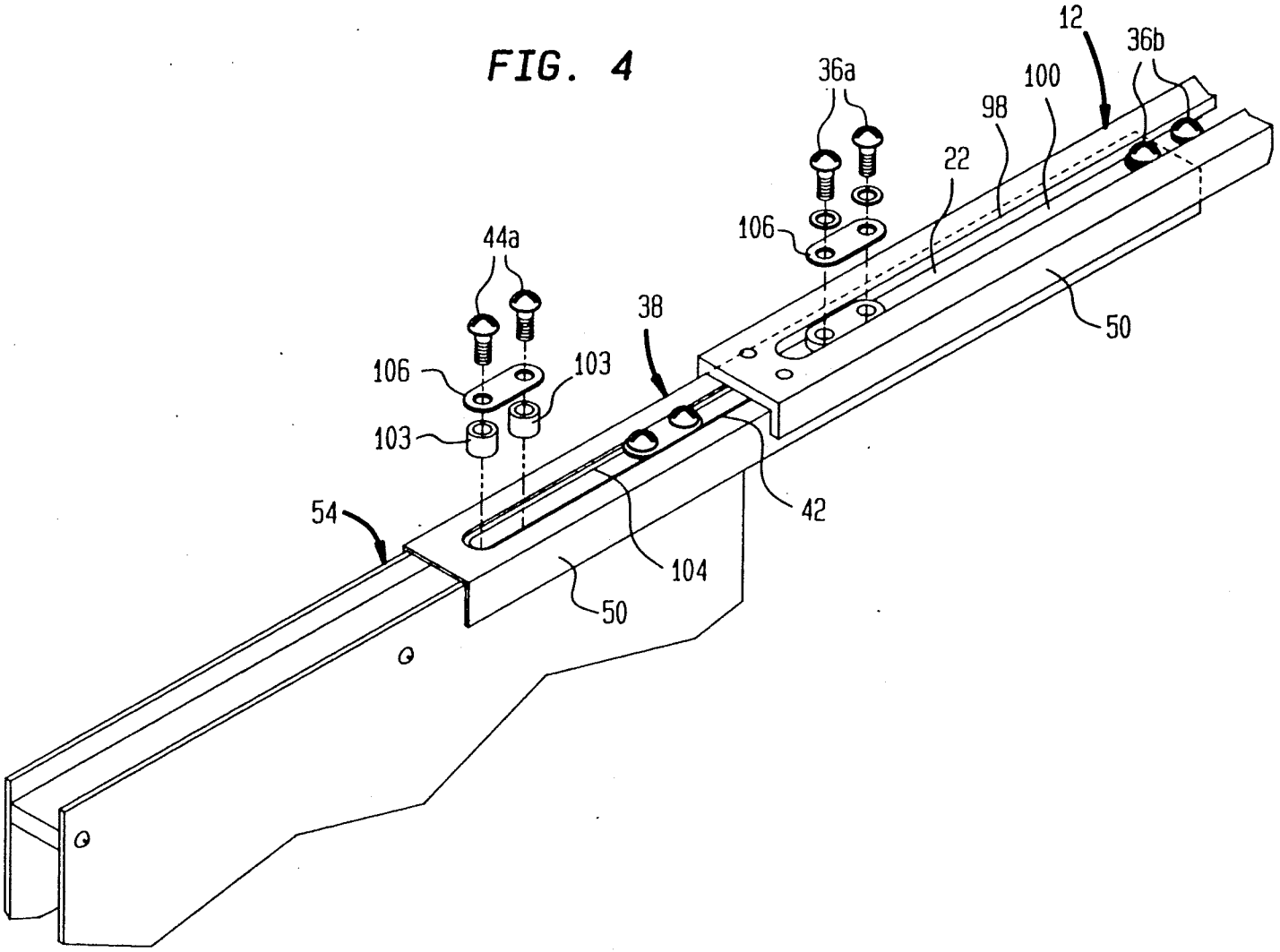
FIG. 4 is a partially exploded perspective view of an alternative embodiment of the device shown in FIG. 1.

Referring to FIG. 4, an alternative embodiment of the device is there illustrated. The alternative embodiment depicted employs a molded guide bar 12 and slide bar 38, each preferably composed of a glass filled nylon or an equivalent material and fabricated by an injection molding process. The guide bar 12 of the alternative embodiment employs a molded-in guide groove 98 in the base 100 of which a guide slot 22 is provided. The slide bar 38 similarly is provided with a slide groove 102 in the bottom of which is disposed the slide slot 42. A slide surface 104 is provided proximate the guide slot 22 and slide slot 42 on which a slip washer 106 may slide. Due to the properties of injection molded plastic, in contrast to that of sheet metal, it is preferable to duplicate and gang the drawer and slide bar suspender screws 44*a* and *b* and 36*a* and *b*, into groups of 2, to more evenly distribute the load forces. The slip washers 106, preferably constructed of Teflon or brass, are likewise designed to accommodate a pair of suspender screws 44*a* , 44*b*, 36*a* and 36*b*.

Figure 5:
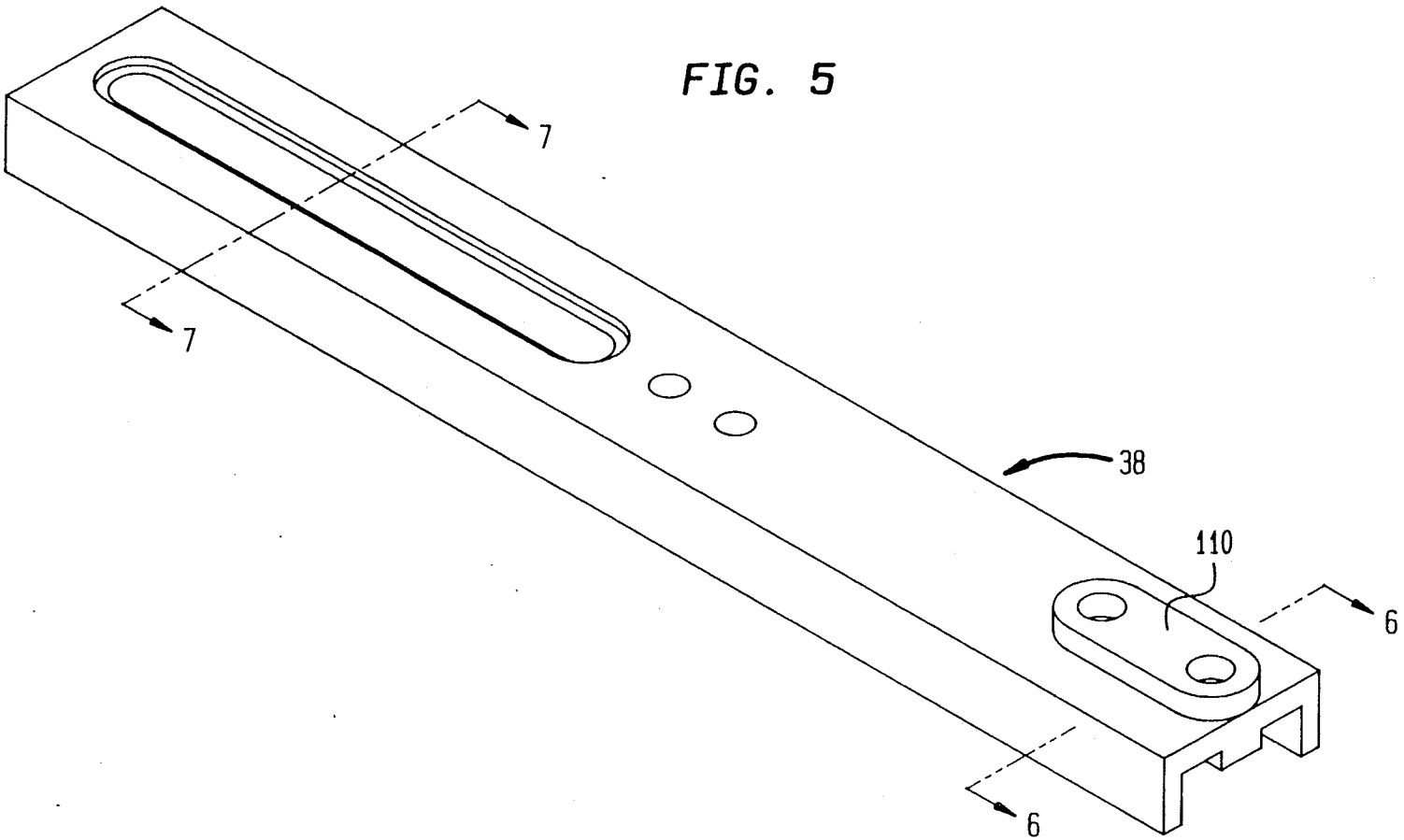
FIG. 5 is a perspective view of the slide bar portion of the device illustrated in FIG. 4.
Figure 6:
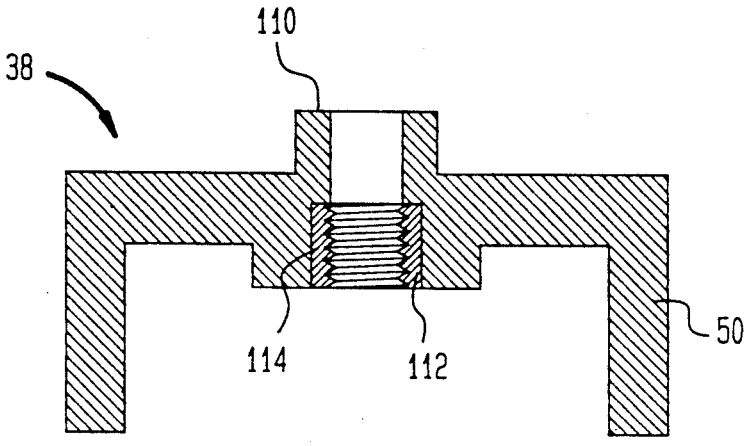
FIG. 6 is a cross-sectional view, taken along section line VI—VI in FIG. 5 and looking in the direction of the arrows of the device shown in FIG. 5.

The molded guide bar 12 and slide bar 38 are provided with side members 50 for added strength against bending forces and to firmly restrain the motion of the slide bar 38 and the drawer 54 respectively between them. FIG. 4 further shows two alternative schemes for performing the function previously performed by the threaded standoff plugs 78 and 84 in the first referenced embodiment. The first alternative is to provide threaded apertures 90 within the sidewall 62 as before and as illustrated in FIG. 3 and further to provide spacers 108, preferably composed of a plastic with a Teflon component, between the slide bar 38 and the sidewall 62. The spacers 108 may also be provided with a top lip (not shown) for increasing the surface area of the spacer 108 where it takes the frictional loading. The second alternative, as more clearly depicted in FIG. 5 includes a spacer 110 monolithically molded into the slide bar 38. Referring to FIG. 6 a cross-sectional view of the molded spacer 110 is depicted. A locking threaded insert 112 is affixed within a graduated bottom bore 114 to provide threaded attachment means for receiving the slide bar suspender screws 36*a* and 36*b*.

Figure 7:
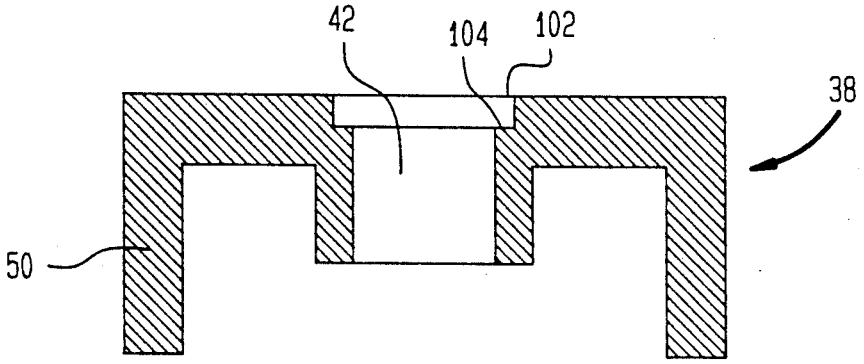
FIG. 7 is a cross-sectional view, taken along section line VII—VII in FIG. 5 and looking in the direction of the arrows of the device shown in FIG. 5.

Referring now to FIG. 7, wherein is shown a cross-section of the molded slide bar 38 with the previously described slide groove 102 slide surface 104 and slide slot 42. Both FIG. 6 and FIG. 7 illustrate the side members 50 which extend downward and embrace either the slide bar 38 or the drawer 54.

The device disclosed herein is useful as a slide for suspending, supporting and sliding drawers into and out of enclosures, cabinets, racks or frameworks and is especially useful for heavy drawer loads. The present invention is an appropriate slide for electrical equipment drawers due to the vertical arrangement of a pair of slides relative to each other which allows easy access to the back planes and electrical equipment attached thereto, e.g., circuit cards. The present invention provides enhanced vertical load bearing capacity to support heavy electronic equipment drawers which must be extended maximally outward to allow access to the elctronics for installation, removal and repair. The device also prevents inadvertantly pulling a heavy drawer beyond its intended travel and free of its attachment to a cabinet or rack. A drawer slide system in accordance with the present invention is quick and simple to assemble and disassemble, requiring only the insertion or removal of a few machine screws, and a drawer retained thereon can be removed or installed with the same degree of ease.

It should be understood that the embodiments described herein are merely exemplary and that a person skilled in the art may make many variations and modifications without departing from the spirit and scope of the invention as defined in the appended claims.

I claim:

1. A drawer slide for suspending and supporting a drawer from a drawer holder comprising:

(a) a guide bar rigidly affixed to said drawer holder and having a slot therein;

(B) primary suspension means passing through said slot upon which a drawer load may be attached, said drawer load hanging from and below said primary suspension means where said primary suspension means passes through said slot, said primary suspension means being slidable within said slot;

(C) a slide bar having a slot therein;

(D) additional suspension means; wherein (E) said primary suspension means attach to said slide bar and said additional suspension means pass through said slide bar slot and attach to said drawer, said drawer load hanging from and below said additional suspension means where said additional suspension means passes through said slide bar slot, and said additional suspension means are slidable within said slide bar slot.

2. A drawer slide in accordance with claim 1, further comprising (A) slide bar attachment means for removeably attaching said primary suspension means to said slide bar; and (B) drawer attachment means for removeably attaching said additional suspension means to said drawer.

3. A drawer slide in accordance with claim 2 wherein said slide bar attachment means are disposed on said slide bar toward an end of said slide bar, said slide bar slot extending from a point proximate said slide bar attachment means to a point proximate another end of said slide bar and wherein said drawer attachment means are disposed on a surface of said drawer to permit said drawer to extend from said drawer holder further than said slide bar extends therefrom.

4. A drawer slide in accordance with claim 1, wherein said guide bar slot extends medially along a substantial portion of said guide bar's length and wherein said slide bar slot extends medially along said slide bar's length.

5. A drawer slide in accordance with claim 4 wherein said slide bar slot is disposed within a recess such that said additional suspension means do not protrude above said recess.

6. A drawer slide in accordance with claim 2 wherein said drawer slide constitutes a first drawer slide and further including a second drawer slide having a duplicate construction as said first drawer slide affixed to a bottom portion of said drawer distal to said first drawer slide, said guide bar of said second drawer slide being ridgedly affixed to said drawer holder below said drawer and in vertical alignment with said first drawer slide.

7. A drawer slide for suspending and supporting a drawer from a drawer holder comprising:

(A) a guide bar rigidly affixed to said drawer holder and having a slot therein extending medially along a substantial portion of the length of said guide bar;

(B) primary suspension means passing through said slot upon which a drawer load may be attached, said primary suspension means being slidable within said slot;

(c) a slide bar having a slot therein extending medially along a portion of the length of said slide bar;

(D) additional suspension means, said primary suspension means attaching to said slide bar by removeable slide bar attachment means disposed on said slide bar proximate an end thereof, said slide bar slot extending from a point proximate said slide bar attachment means to a point proximate another end of said slide bar, said additional suspension means passing through said slide bar slot and attaching to said drawer by removeable drawer attachment means disposed on a surface of said drawer to permit said drawer to extend from said drawer holder further than said slide bar extends therefrom, said additional suspension means being slideable within said slide bar slot, said slide bar slot being disposed within a recess such that said additional suspension means do not protrude above said recess.

8. A drawer slide in accordance with claim 7, wherein said primary suspension means includes friction reducing means disposed between said primary suspension means and said guide bar for reducing the friction between said primary suspension means and said guide bar when said primary suspension means are slide within said guide bar slot and said additional suspension means includes additional friction reducing means disposed between said additional suspension means and said slide bar for reducing the friction between said additional suspension means and said slide bar when said additional suspension means are slid within said slide bar slot.

9. A drawer slide in accordance with claim 8 wherein said primary suspension means includes spacer means disposed between said slide bar and said guide bar for reducing sliding friction therebetween and wherein said additional suspension means includes additional spacer means disposed between said drawer and said slide bar for reducing sliding friction therebetween.

10. A drawer slide in accordance with claim 9 wherein said slide bar and said guide bar include sidewall members extending downward therefrom to provide added resistance to bending in a direction perpendicular to their lengths, said sidewall members of said guide bar being spaced apart to accommodate said slide bar therebetween and said sidewall members of said slide bar having a spacing therebetween to accommodate said drawer.

11. A drawer slide in accordance with claim 10 wherein said primary suspension means includes a screw having a threaded portion which passes through said guide bar slot and a head which does not pass through, said threaded portion being received in said slide bar attachment means having a female threaded portion and wherein said additional suspension means include an additional screw having a threaded portion which passes through said slide bar slot and a head which does not pass through, said threaded portion of said additional screw being received in said drawer attachment means having a corresponding female threaded portion.

12. A drawer slide in accordance with claim 11 wherein said guide bar and said slide bar are formed sheet metal and have a generally C-shaped cross-section, said C-shape being defined by an intermediate wall with two legs coextending therefrom at approximate 90 degree angles, said side members forming said legs, said intermediate wall having said recess therein, said recess having a smaller c-shaped cross section reversed relative to said generally C-shaped cross-section and defined by an interior wall and two coextensive leg members projecting at approximately 90 degrees therefrom and connecting to said intermediate wall.

13. A drawer slide in accordance with claim 12 wherein said spacer means is affixed to said slide bar, extends from said interior wall of said recess to a plane containing said intermediate wall, and includes therein said female threaded portion.

14. A drawer slide in accordance with claim 13 wherein said friction reducing means is a plastic washer for receiving said threaded portion of said screw having a spindle portion which slideably inserts through said guide slot and a washer portion, said spindle portion abutting against said spacer means and said washer portion captured between said head of said screw and said guide bar, and wherein said additional friction reducing means is another plastic washer for receiving said threaded portion of said additional screw having a spindle portion which slideably inserts through said slide slot and a washer portion, said spindle portion abutting against said additional spacer means and said washer portion captured between said head of said additional screw and said slide bar.

15. A drawer slide in accordance with claim 14 wherein said primary suspension means includes a first suspension means and further includes a second suspension means having a duplicate construction as said first suspension means, said first and second suspension means being spaced apart to distribute said drawer load and wherein said additional suspension means includes a first additional suspension means and further includes a second additional suspension means having a duplicate construction as said first additional suspension means, said first and second additional suspension means being spaced apart to distribute said drawer load and wherein said spacer means includes a bottom lip proximate one end thereof, said spacer means being received within a bore having an annular recess for receiving said lip, said spacer means being press fit within said bore such that said spacer means distal to said lip passes through said bore, said annular recess receiving said lip, said lip preventing said spacer means from passing completely through said bore, and said suspension means including a flat washer and a lock washer disposed between said head of said screw and said plastic washer and said additional suspension means including a flat washer and a lock washer disposed between said head of said additional screw and said another plastic washer.

16. A drawer slide in accordance with claim 15 wherein said guide bar and said slide bar are coated with a friction reducing coating.

17. A drawer slide in accordance with claim 16 wherein said drawer slide constitutes a first drawer slide and further including a second drawer slide having a duplicate construction as said first drawer slide affixed to a bottom portion of said drawer distal to said first drawer slide, said guide bar of said second drawer slide being ridgedly affixed to said drawer holder below said drawer and in vertical alignment with said first drawer slide.

18. A drawer slide in accordance with claim 11 wherein said guide bar and said slide bar are molded plastic, said suspension means includes a stepped bore having an outer bore and a narrower concentric inner bore in a surface of said slide bar means proximate said drawer and said female threaded portion is a threaded insert pressed into said outer bore, said inner bore penetrating another surface of said slide bar proximate said guide bar for receiving said screw.

19. A drawer slide in accordance with claim 18 wherein said spacer means are monolithically molded into said slide bar, said guide bar having a bottom recess coextensive with said recess for slideably receiving said molded spacer means, and further including duplicate primary suspension means and duplicate additional suspension means and wherein said friction reducing means include a slip plate captured between said head of said screw and said guide bar and said additional friction reducing means include a slip plate captured between said head of said additional screw and said slide bar.

20. A drawer slide in accordance with claim 10 wherein said drawer slide constitutes a first drawer slide and further including a second drawer slide having a duplicate construction as said first drawer slide affixed to a bottom portion of said drawer distal to said first drawer slide, said guide bar of said second drawer slide being ridgedly affixed to said drawer holder below said drawer and in vertical alignment with said first drawer slide.

21. A drawer slide system for suspending and supporting a drawer from a drawer holder comprising:

(A) a first drawer slide having
  (i) a guide bar rigidly affixed to said drawer holder and having a slot therein;
  (ii) primary suspension means passing through said slot upon which a drawer load may be attached, said primary suspension means being slidable within said slot;
  (iii) a slide bar having a slot therein;
  (iv) additional suspension means, said primary suspension means attaching to said slide bar by removeable slide bar attachment means, said additional suspension means passing through said slide bar slot and attaching to said drawer by removeable drawer attachment means, said additional suspension means being slideable within said slide bar slot;

(B) a second drawer slide having the same construction as said first drawer slide, affixed to a bottom portion of said drawer distal to said first drawer slide, said guide bar of said second drawer slide being rigidly affixed to said drawer holder below said drawer and in vertical alignment with said first drawer slide.

* * * * *